United States Patent [19]

Katzman et al.

[11] Patent Number: 4,674,169

[45] Date of Patent: Jun. 23, 1987

[54] METHOD OF MAKING A PERMANENT DOLL WIG

[75] Inventors: Allison W. Katzman; Rouben T. Terzian, both of Chicago; Jeffrey D. Breslow, Highland Park, all of Ill.

[73] Assignee: Marvin Glass & Associates, Chicago, Ill.

[21] Appl. No.: 827,344

[22] Filed: Feb. 7, 1986

[51] Int. Cl.[4] ..... B23P 11/00; B32B 7/08

[52] U.S. Cl. ..... 29/432; 29/451; 132/56; 156/93; 446/394

[58] Field of Search ..... 29/432, 450; 446/394; 156/93; 132/56, 5

[56] References Cited

U.S. PATENT DOCUMENTS

| | | | |
|---|---|---|---|
| 1,090,198 | 3/1914 | Butler | 132/5 |
| 2,253,635 | 8/1941 | Mann | 446/394 |
| 2,645,057 | 7/1953 | Napolitan | 446/394 |
| 2,695,621 | 11/1954 | Cox | 132/56 |
| 2,697,304 | 12/1954 | Welch | 446/394 |
| 3,225,489 | 12/1965 | Ryan | 446/394 |
| 3,765,123 | 10/1973 | Terzian | 446/394 |
| 4,070,790 | 1/1978 | Strongin et al. | 446/394 |

FOREIGN PATENT DOCUMENTS

| | | | |
|---|---|---|---|
| 809054 | 2/1959 | United Kingdom | 446/394 |
| 997266 | 7/1965 | United Kingdom | 446/394 |

*Primary Examiner*—Charlie T. Moon

*Attorney, Agent, or Firm*—John S. Pacocha

[57] ABSTRACT

A method of making a permanently attached doll wig integrating a high pile, backed piece of material and strands of synthetic doll hair rooted through both the material and the doll head. Initially, the material is attached to the doll head pile side down by a line of stitching. The material is then folded over and held in place by an adhesive and permanently secured by rooting strands of synthetic doll hair through both the material and the doll head. Rooting some synthetic doll hair directly into the doll head adjacent to, but beyond, the edges of the material, obscures the edges.

13 Claims, 7 Drawing Figures

METHOD OF MAKING A PERMANENT DOLL WIG

BACKGROUND OF THE INVENTION

1. Field of the Invention

This invention relates generally to doll wigs and more particularly to a method of making a permanently attached doll wig.

2. Background Art

Rooting synthetic hair strands or filaments into the head of a doll to produce various hair styles is old in the doll making art. While such rooted hair provides combing and other hair care play, the ability of such rooted hair to hold or retain other than a preselected style is limited. Moreover, the "body" of such rooted hair style is directly dependent upon the density of the rooting and denser rooting is more difficult and expensive. The difficulty and expense of rooting is further increased when it is desired to produce a wig having different strand lengths or colors. U.S. Pat. Nos. 3,765,123 and 4,070,790 disclose combined insertable or attachable supplemental hair pieces with a permanently attached wig to provide variation in styling. However, there remains a need for a method of making a permanent doll wig that provides wigs that are relatively easy for the child to style, have a better holding capability for various child imparted styles and provide a different look from that obtainable by conventional doll wig attaching processes.

SUMMARY OF THE INVENTION

The present invention is concerned with providing a method of making a permanently attached doll wig that integrates two different types of material to produce different looks and has better styling and holding ability than conventional hair rooting. These and other objects and advantages of the invention are achieved by initially attaching a high pile, backed piece of material to a part of a doll made from a thermoplastic and then rooting strands of synthetic hair through both the material and the part. Initially the material may be attached by some adhesive and/or by a single line of stitching along the hair line. To obscure the edge of the material, rooting of the synthetic doll hair may extend beyond the material directly into the part of the doll. A preferred method uses synthetic doll hair that is longer, of a lighter color, and has a greater memory than the pile of the material.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
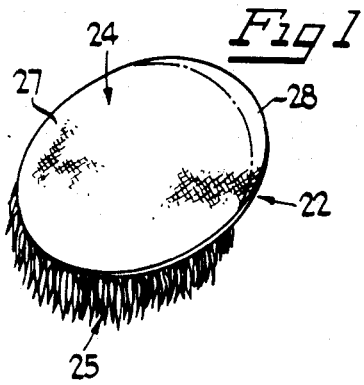
FIG. 1 is a perspective view of the underside of a component used in the method of the present invention.

Referring now to the drawings in which like parts are designated by like reference characters throughout the several views, FIGS. 2–6 show a hollow doll head 10 molded in a conventional manner from a thermoplastic such as polyvinylchloride or some other vinyl. The doll head is preferably flexible, though sufficient rigid in ambient conditions to allow definition of a face 12 with eyes 13, a nose 14, ears 15, a mouth 16, a chin 17 and a neck 18. Head 10 includes a substantially smooth cap portion 20 extending generally from the forehead or brow up back and around the head down to a line above the nape of the neck and joined by lateral boundaries passing adjacent the top of the dolls ears. This described boundary of cap 20 corresponds to the hair line of the finished doll head.

Figure 2:
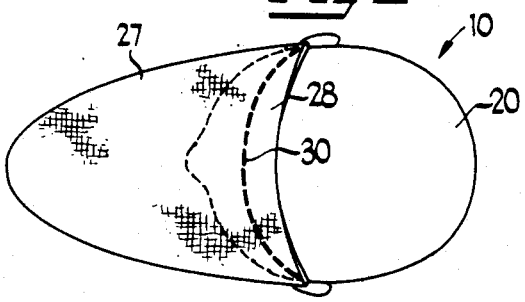
FIG. 2 is a top plan view showing the component attached to a doll head.
Figure 3:
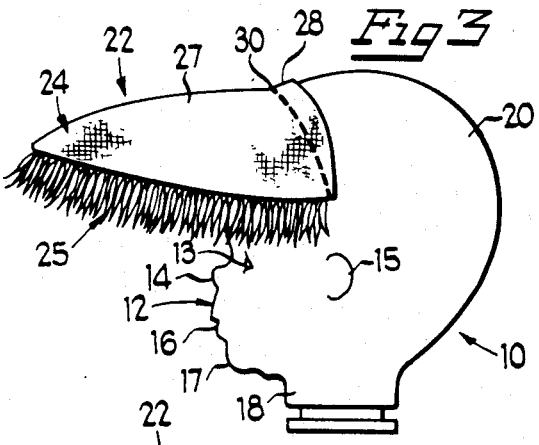
FIG. 3 is a side elevational view of the same step shown in FIG. 2.
Figure 4:
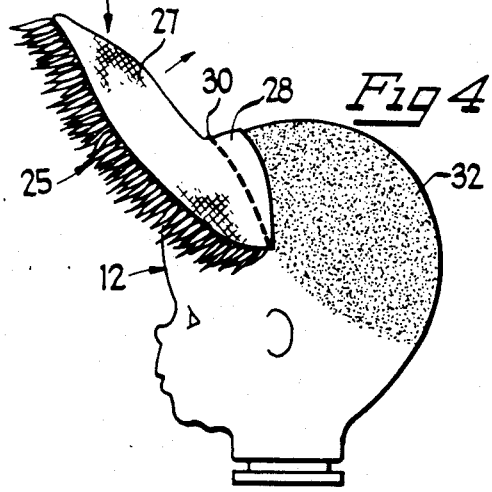
FIG. 4 is a side elevational view of a subsequent step.

FIG. 1 shows the underside of a high pile, backed piece of material 22 includes a backing 24 and high pile 25. Material 22 is cut out with a principal part 27 that will substantially conform to the boundaries of smooth cap portion 20. In addition, the piece of material 22 has a short lip 28. As shown in FIGS. 2 and 3, material 22 is initially attached to head 10, pile side down by a line of stitching 30 extending along a front section of the smooth cap boundary. Stitch line 30 follows the junction between the main part 27 and lip 28. When material 22 is folded over, pile side up, there will be a well defined front hair line.

Figure 5:
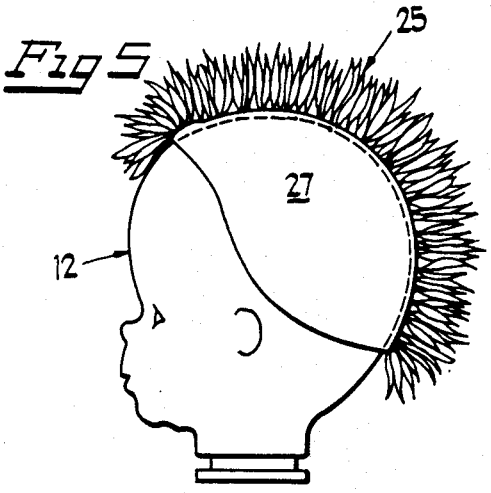
FIG. 5 is a side elevational of a still further step.

Cap portion 20 is then covered with a suitable adhesive 32. The main purpose of the adhesive is to hold the material 22 on the doll head until the step of rooting the synthetic doll hair is completed. While there are a number of available adhesives for bonding backing 24 to the thermoplastics used for doll heads, contact cement has been found to work well. After the adhesive is applied to the cap portion, material 22 is folded up over stitch line 30 trapping lip 28 beneath the principle part 27. FIG. 5 illustrates the partially completed wig at this stage of the process.

Figure 6:
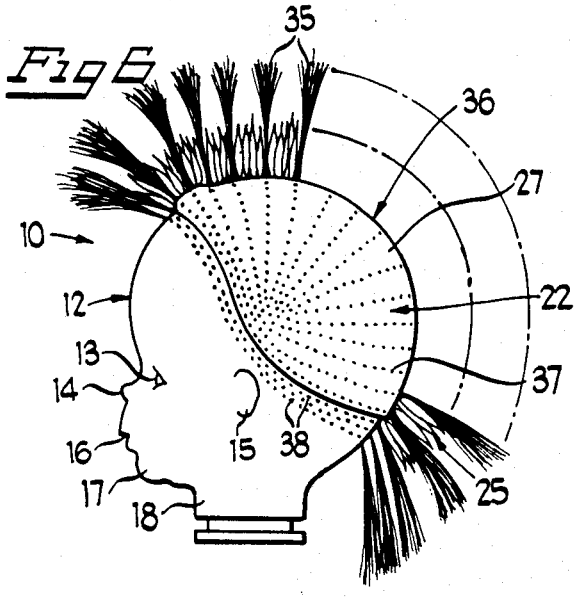
FIG. 6 is a side elevational view of the completed process.
Figure 7:
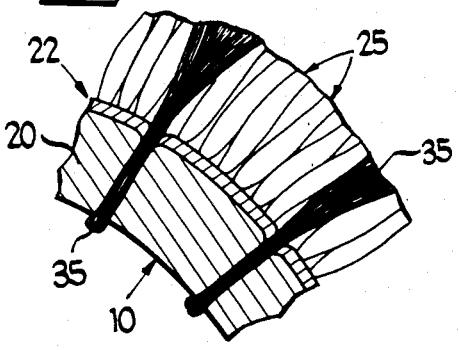
FIG. 7 is an enlarged scale, fragmentary sectional view of the completed process.

Strands of synthetic doll hair 35 are then rooted through material 22 and cap portion 20 of doll head 10 by a conventional hair rooting process. Rooting of synthetic doll hair through material 22 firmly and permanently secures it to the doll head. FIG. 6 shows a pattern 36 of rooting the synthetic doll hair that works well with the present invention. In addition to a line 37 of synthetic hair rooted through material 22 adjacent the edge of the piece, one or more additional lines 38 of synthetic hair may be rooted directly into doll head 20 beyond the edge of material 22 to obscure the edge.

While various types of synthetic doll hair may be used in the process, it has been found that using synthetic that is longer, of a lighter color, and a greater memory than pile 25 produces a desirable end product. The combined synthetic doll hair and the pile provides a "body" that cannot be obtained by conventional hair rooting, except possibly by very dense rooting which is both difficult and expensive. This greater "body" enables a child to do much more styling play with the doll wig. Combinations of color provide entertaining variation and the use of a lighter color synthetic doll hair than the pile adds a sparkle to the completed wig.

While a preferred method has been shown and described, some of the steps may be changed or modified. For example, lip 28 could be omitted and material 22 initially attached by stitching part 27 onto the head pile side up. In yet another modification, the initial attachment may be done solely by gluing material 22 to the head without any initial stitching. Further changes and modifications will occur to those skilled in the art. It is intended in the appended claims to cover all such changes and modifications as fall within the true spirit and scope of the present invention.

What is claimed as new and desired to be secured by Letters Patent is:

1. A method of making a part of a doll with a permanently attached wig comprising the steps of:

forming a part of a doll from a thermoplastic;

initially attaching a high pile, backed piece of material to the part; and rooting strands of synthetic doll hair through both the material and the part.

2. The method of claim 1 in which the initial attaching is by stitching of the material to the part.

3. The method of claim 2 in which the stitching is done in a line along a section of the desired final hair line between the part and the material.

4. The method of claim 3 in which the material is initially placed backed side up, stitched along a line and then folded pile side up over the stitched line.

5. The method of claim 4 in which an adhesive is applied between the part and the folded over material.

6. The method of claim 4 in which a relatively short lip of material is left between the stitching and the part and the lip is then trapped under the folded over material.

7. The method of claim 6 in which the stitched line is along the junction between the lip and the rest of the material.

8. The method of claim 1 in which the initial attaching is done by gluing the material to the part.

9. The method of claim 1 in which the rooting of synthetic doll hair is also done directly into the part adjacent to, but beyond, the edges of the material.

10. The method of claim 1 using strands of synthetic doll hair that are longer than the pile of the material.

11. The method of claim 1 including using synthetic doll hair of a color different than the pile of the material.

12. The method of claim 1 including using synthetic hair of a lighter color than the pile of the material.

13. The method of claim 1 including using synthetic hair of a relatively greater memory than the pile of the material.

* * * * *